US009493858B2

(12) United States Patent
Kuhn et al.

(10) Patent No.: US 9,493,858 B2
(45) **Date of Patent: *Nov. 15, 2016**

(54) COPPER ALLOY

(75) Inventors: Hans-Achim Kuhn, Illertissen (DE); Andrea Kaeufler, Neu-Ulm (DE); Stefan Gross, Ulm (DE)

(73) Assignee: WIELAND-WERKE AG, Ulm (DE)

( * ) Notice: Subject to any disclaimer, the term of this patent is extended or adjusted under 35 U.S.C. 154(b) by 15 days.

This patent is subject to a terminal disclaimer.

(21) Appl. No.: 14/235,884

(22) PCT Filed: Jun. 15, 2012

(86) PCT No.: PCT/EP2012/002523

§ 371 (c)(1),
(2), (4) Date: Jan. 29, 2014

(87) PCT Pub. No.: WO2013/023717

PCT Pub. Date: Feb. 21, 2013

(65) Prior Publication Data

US 2014/0161661 A1 Jun. 12, 2014
US 2014/0377127 A9 Dec. 25, 2014

(30) Foreign Application Priority Data

Aug. 13, 2011 (DE) ..... 10 2011 110 588

(51) Int. Cl.
*C22C 9/04* (2006.01)

(52) U.S. Cl.
CPC ..... *C22C 9/04* (2013.01)

(58) Field of Classification Search
CPC ..... C22C 9/04
USPC ..... 420/472, 473, 477, 478, 479, 481
See application file for complete search history.

(56) References Cited

U.S. PATENT DOCUMENTS

| | | | | |
|---|---|---|---|---|
| 3,816,109 | A | 6/1974 | Crane et al. | |
| 4,047,978 | A | 9/1977 | Parikh et al. | |
| 4,259,124 | A | 3/1981 | Smith et al. | |
| 5,853,505 | A | 12/1998 | Brauer et al. | |
| 5,893,953 | A * | 4/1999 | Bhargava | 148/685 |
| 6,132,528 | A | 10/2000 | Brauer et al. | |
| 6,627,011 | B2 * | 9/2003 | Sugawara | C22C 9/04 148/682 |
| 2001/0001400 | A1 * | 5/2001 | Brauer et al. | 148/433 |
| 2003/0129076 | A1 | 7/2003 | Sugawara et al. | |
| 2014/0170016 | A1 * | 6/2014 | Kaeufler et al. | 420/472 |

FOREIGN PATENT DOCUMENTS

| | | | |
|---|---|---|---|
| CN | 1314956 | A | 9/2001 |
| CN | 1403609 | A | 3/2003 |
| EP | 1 290 234 | B1 | 6/2006 |
| JP | 63-026320 | A | 2/1988 |
| JP | 01-165734 | A | 6/1989 |
| JP | 2005-60773 | A | 3/2005 |
| JP | 2006-152392 | A | 6/2006 |
| JP | 2009-62610 | A | 3/2009 |
| JP | 5144814 | B2 | 11/2012 |
| WO | WO 99/67433 | A1 | 12/1999 |
| WO | WO 2011-019042 | A1 | 2/2011 |

OTHER PUBLICATIONS

Yamaguchi, JP Pub. No. 2005-060773 (machine translation).*
English Translation of International Search Report issued in PCT/EP2012/002523, with a mailing date of May 2, 2013 (3 pages).
"Mechanical Twinning and its Effects on Static Recrystallization Behavior of Cu—Zn Alloy"; Miura et al.; Journal of the JRICu vol. 48, No. 1; Dec. 31, 2009; pp. 27-33 (7 pages).
Germany Office Action from corresponding application No. 10 2011 110 588.7, dated Apr. 24, 2012 (5 pgs).
China Office Action from corresponding application No. 201280039553.7, with partial English translation, dated Feb. 28, 2015 (10 pgs).
Japan Office Action from corresponding application No. 2014-524282, with partial English translation, dated Oct. 29, 2015 (14 pgs).
Japan Office Action from corresponding application No. 2014-524282, with partial English translation, dated Jun. 17, 2016 (6 pgs).

* cited by examiner

*Primary Examiner* — Jessee Roe
*Assistant Examiner* — John Hevey
(74) *Attorney, Agent, or Firm* — Flynn, Thiel, Boutell & Tanis, P.C.

(57) ABSTRACT

A copper alloy subjected to a thermo-mechanical treatment and composed of (in wt %) 15.5 to 36.0% Zn, 0.3 to 3.0% Sn, 0.1 to 1.5% Fe, optionally 0.001 to 0.4% P, optionally 0.01 to 0.1% Al, optionally 0.01 to 0.03% Ag, Mg, Zr, In, Co, Cr, Ti, Mn, optionally 0.05 to 0.5% Ni, the remainder being copper and unavoidable contaminants, wherein the microstructure of the alloy is characterized in that the proportions of the main texture orientations are at least 10 vl % copper orientation, at least 10 vl % S/R orientation, at least 5 vl % brass orientation, at least 2 vl % Goss orientation, at least 2 vl % 22RD-cube orientation, at least 0.5 vl % cube orientation, and finely distributed iron-containing particles are contained in the alloy matrix.

6 Claims, No Drawings

COPPER ALLOY

The invention relates to a copper alloy.

Electronic components, including terminal contacts, form the foundation of information technology. One of the most important considerations in each terminal contact is optimization of the embodiment at the lowest costs. With the continuous price pressure, the demand exists in the electronics industry, inter alia, for alternative materials to such materials, which have the desired properties and which are also cost-effective. Desired properties of an alloy are, for example, high electrical and thermal conductivity and also high stress relaxation resistance and tensile strength. Typically, copper alloys are used as terminal clamps and also for other electrical and thermal applications, because of the generally outstanding corrosion resistance thereof, the high electrical and thermal conductivity, and the good storage and wear qualities. Copper alloys are also suitable because of the good cold machining or hot machining properties thereof and the good deformation property thereof.

A copper alloy is known from the publication EP 1 290 234 B1, which already displays a more cost-effective alternative to otherwise typical copper alloys having high electrical conductivity, high tensile strength, and high shaping strength. The alloy consists of 13 to 15% zinc, 0.7 to 0.9% tin, 0.7 to 0.9% iron, and a residual balance of copper. As a result of the zinc, having a comparatively low metal value currently on the market, costs can be saved in the base material.

A copper alloy, which has a zinc proportion of at most 15.0%, is known from the patent specification U.S. Pat. No. 3,816,109. The iron content is between 1.0 and 2.0%. Using this composition, a comparatively good electrical conductivity is achieved in conjunction with sufficient tensile strength.

Furthermore, copper-tin-iron-zinc alloys are known from the patent specification U.S. Pat. No. 6,132,528, which have a higher zinc content of up to 35.0%. The iron proportion is between 1.6 and 4.0%. The addition of iron has the function of achieving grain refinement already after the casting.

The invention is based on the object of refining a copper alloy in such a manner as to refine it with respect to the stress relaxation resistance and further material properties. In particular when processed as a strip material, the alloy is to be oriented to the technical properties of the bronzes CuSn4 (C51100) and CuSn6 (C51900), with a low metal value at the same time. In addition, the manufacturing pathway is to be made as simple as possible. With respect to the tensile strength, values are to be 600 MPa, the electrical conductivity is to be at least 20% IACS. In addition, the copper alloy processed as strip is to be well bendable and is to be able to be used as a spring material.

The invention is represented by the following features, advantageous embodiments and refinements.

The invention includes a copper alloy, which was subjected to a thermomechanical treatment, consisting of (in wt.-%):

15.5 to 36.0% Zn,
0.3 to 3.0% Sn,
0.1 to 1.5% Fe,
optionally 0.001 to 0.4% P,
optionally 0.01 to 0.1% Al,
optionally 0.01 to 0.3% Ag, Mg, Zr, In, Co, Cr, Ti, Mn,
optionally 0.05 to 0.5% Ni,
the remainder copper and unavoidable impurities, wherein the microstructure of the alloy is characterized in that the proportions of the main texture orientations are at least 10 vol.-% copper orientation,
at least 10 vol.-% S/R orientation,
at least 5 vol.-% brass orientation,
at least 2 vol.-% Goss orientation,
at least 2 vol.-% 22RD cube orientation,
at least 0.5 vol.-% cube orientation, and
finely distributed ferrous particles are contained in the alloy matrix.

The copper alloy according to the invention primarily relates to strip, wire, or tubular material, having as the main components copper, zinc, tin, and iron. The zinc content between 15.5 and 36.0% is selected in the alloy in particular according to the criterion that a single-phase alloy which can be easily shaped is obtained. The single-phase base microstructure consists of alpha phase. The base microstructure must also be suitable for absorbing the finest possible precipitants of other elements. It has been shown that the zinc content should not exceed 36.0%, since otherwise a less favorable phase composition results in the alloy. In a preferred embodiment, a zinc content of at most 32.0% is not exceeded. In particular in the case of zinc contents which exceed the specified value, the brittle beta phase occurs, which is undesirable in this context. On the other hand, extensive experimental results of an alloy variant having 30.0% zinc have shown that the desired properties are still ensured. An important property of the alloy is its resistance against stress relaxation and stress crack corrosion. On the other hand, economic aspects are also to be mentioned in the solution according to the invention. Thus, the element zinc can still currently be purchased at a reasonable price in the market and is available, in order to thus produce alloys which are more favorable in the metal price, the properties of which at least extend to heretofore known alloys. Thus, the alloys according to the invention have a lower metal value than conventional copper-tin-phosphor alloys. The material properties are also to be oriented to these alloys.

From a technical aspect, a higher tin content in the alloy according to the invention affects the strength and the relaxation resistance. On the other hand, the tin content should not exceed 3.0%, since the conductivity and the bending ability are negatively influenced thereby. In principle, the tin concentration is to be kept as low as possible; however, no substantial influence on the alloy properties can still be expected at a proportion less than 0.3%

Iron is responsible for the formation of precipitation particles and therefore provides an improvement of the relaxation properties in comparison to typical brasses. The precipitation formation can be controlled and optimized during the manufacturing process. In particular, precipitants form in this alloy during a hot rolling step with a following targeted cooling. The annealing mechanisms active in the alloy are primarily borne by the element iron.

The ferrous particles present in the alloy matrix form in the submicrometer range. The further elements optionally contained in the alloy can cause a further property improvement of the alloy with respect to the process control or can also display the effect thereof during the production process in the molten phase. A further key property is the bending ability in strips, which is improved in particular at higher zinc contents. The experimental results showed that both for low and for high zinc contents, approximately equal levels of residual stresses occur in the alloy. It is essential that in the alloy according to the invention, the relaxation resistance is significantly improved in relation to the typical brasses and is only slightly below the typical values for bronze. The present brass alloy is therefore in the range of the commercially available tin bronzes with respect to the relaxation resistance.

In the alloy according to the invention, particular weight is placed on the microstructure thereof, which displays a special combination of main texture orientations as a result of the processing steps. The texture arises in the manufacturing during the thermomechanical treatment as a result of different rolling processes. Rolling shaping steps can comprise, on the one hand, cold rolling steps and intermediate annealing steps and, on the other hand, hot rolling processes in conjunction with further cold rolling steps and intermediate annealing steps. The formation of the alloy according to the invention having the specified main texture orientations must be adapted in processing technology precisely to the formation of the finely distributed ferrous particles in conjunction with the respective degrees of rolling reduction. The optimum of the expected property combinations can only thus be achieved.

The desired material parameters are of interest in particular for the design of spring elements, for example, because the stiffness of the spring and the carrying capacity thereof are thus determined. A close relationship exists between the resulting texture orientations and the mechanical anisotropy resulting therefrom. Cubic face-centered metals typically form two different texture types after a high degree of rolling deformation as a function of the stacking fault energy thereof. In metals having moderate to high stacking fault energy, such as aluminum and copper, the so-called copper rolling texture is found, which is composed of the ideal orientations, the so-called brass orientation, and also the S orientation and the copper orientation. The second limiting type is the so-called alloy rolling texture, which is formed by metallic materials of low stacking fault energy, which also includes most copper alloys, and which substantially consists of the brass orientation. Texture studies on copper and copper-zinc alloys and also electron-microscope studies of copper and CuZn30 in recent time have shown that CuZn30 behaves similarly at lower degrees of shaping with respect to the microstructure and the texture formation to copper and the typical brass rolling texture first results at moderate to high degrees of rolling as a result of the twin and shear band formations which then begin. At lower degrees of rolling, the occurrence of mixed texture types is accordingly also to be expected in copper alloys having lower stacking fault energy.

Therefore, in strips of the alloy according to the invention, particularly advantageous textures and directional dependences of the mechanical properties result. Texture types as a mixed texture between the limiting cases of a copper orientation, on the one hand, and a brass orientation, on the other hand, are formed by comparatively low degrees of rolling reduction. The respective advantageous properties resulting are directly dependent thereon.

The special advantage is that the resistance of the alloy according to the invention with respect to stress relaxation is substantially better than tin-free and iron-free copper-zinc alloys and the alloy simultaneously has a lower metal value than copper-tin-phosphor alloys. Surprisingly, the Cu—Zn—Sn—Fe materials according to the invention also display more favorable strength reduction behavior than the tin bronze used in comparable products. The strength loss resulting at the beginning of the recrystallization is less in any case. The ferrous particles present in the alloy matrix are certainly formed sufficiently small, in the submicron range, that good tin plating ability and processing ability to form a plug connector is ensured. In the present matrix composition, the desired intermetallic phases may form with the copper of the alloy matrix during the hot-dip tin plating. The advantageous intermetallic phases also form uniformly on the entire surface in the case of galvanic tin plating with a following reflow treatment. An important requirement of the surface which can be uniformly tin plated is that the small particles do not experience any substantial elongation in the rolling direction in the matrix during mechanical shaping by means of hot rolling or cold rolling. In contrast to higher iron proportions lying outside the solution according to the invention, a line-shaped broadening of larger iron particles, which interferes with the tin plating, does not occur.

In a preferred embodiment of the invention, the content of tin can be 0.7% to 1.5% and that of iron can be 0.5% to 0.7%. A lower tin content in the specified limits is therefore particularly advantageous, because in this way the conductivity and the bending ability of the alloy are further improved. The specified iron content is selected such that particularly fine ferrous particles form in the alloy matrix. However, these particles still have the size to substantially improve the mechanical properties.

The zinc content can advantageously be between 21.5% and 31.5%. In particular in this range, it is still ensured that the desired single-phase alloy consisting of alpha phase can be produced. Such alloys can be shaped more easily and are still suitable for fine precipitation distribution of the ferrous particles. Furthermore, the zinc content can advantageously be between 28.5% and 31.5%.

In a further advantageous embodiment of the invention, the ratio of the proportions of the main texture orientations of brass orientation and copper orientation can be less than 1. In relation to the known brass alloys of similar composition, but without iron precipitants, this quotient displays the special features of this alloy. While in comparable experiments, pure CuZn30 alloys have a quotient of greater than 1.2, the desired mechanical properties form in the strip material at a smaller ratio of the brass orientation to the copper orientation. The level of the stiffness and the carrying capacity of spring materials is thus determined.

The ratio of the proportions of the main texture orientations of brass orientation and copper orientation can advantageously be between 0.4 and 0.90. Particularly favorable mechanical properties of the alloy are formed in the specified range.

In an advantageous embodiment of the invention, finely distributed ferrous particles having a diameter less than 1 μm can be provided at a density of at least 0.5 particles per $\mu m^2$ in the alloy matrix. The combination of the particle size and the distribution thereof in the alloy finally influences the mechanical properties. The described fine distribution having a diameter less than 1 μm is pronounced over 99% and is primarily defining for the advantageous properties. In the typical case, the mean particle diameter of the finely distributed ferrous particles is even less than 50 to 100 nm. If such small particles are subjected to mechanical forming by means of hot rolling or cold rolling, they do not experience any substantial stretching in the rolling direction, from which the good tin plating ability of the surface then results.

The mean grain size of the alloy matrix can advantageously be less than 10 μm. However, the mean grain size is more preferably at most 5 μm. By way of the combination of the grain size of the alloy matrix in conjunction with the size of the finely distributed ferrous particles and the distribution thereof, an optimum of the alloy properties may be achieved with respect to the mechanical carrying capacity, electrical conductivity, resistance against stress relaxation, and bending ability thereof.

Further exemplary embodiments of the invention will be explained in greater detail on the basis of Tables 1 to 4.

In the tables:

Table 1 lists the composition of the examined copper alloys in wt.-%;

Table 2 lists properties of the alloys according to Table 1 after the last cold rolling to final thickness and annealing for 250° C./3 hours;

Table 3 lists properties of the alloys according to Table 1 after the last cold rolling to final thickness and annealing for 300° C./5 minutes;

Table 4 lists main texture orientations in volume-percent of the alloys from Table 3.

The composition of the individual examples and comparative examples can be inferred from Table 1; the results of the final states are contained in Tables 2 and 3.

COMPARATIVE EXAMPLE 1

(CuZn23.5Sn1.0):—Fine-Grained

The alloy components were melted in the graphite crucible and subsequently laboratory sample blocks were cast in steel ingot molds via the Tammann method. The composition of a laboratory block sample was Cu 75.47%-Zn 23.47%-Sn 1.06% (see Table 1). After the milling to 22 mm thickness, the samples were hot rolled at 700-800° C. to 12 mm and subsequently milled to 10 mm.

After the cold rolling to 1.8 mm, the alloy was annealed at 500° C./3 hours. A yield strength of 109 MPa was achieved at a grain size of 30-35 μm and a conductivity of 26.5% IACS. After the subsequent cold rolling to 0.33 mm and annealing at 320° C./3 hours, the yield strength was 311 MPa at a grain size of 2-3 μm and a conductivity of 27.3% IACS.

After the rolling to the final thickness and tempering at 300° C./5 minutes, at a 24% preceding cold deformation, yield strengths were achieved of 541 MPa at an A10 elongation of 19.3% and a conductivity of 25.1% IACS. The minimum bending radius minBR in relation to the strip thickness t (minBR/t perpendicular/parallel) in the V-forging die was 0.4/1.2. The stress relaxation resistance was 92.3% of the initial stress after 100° C./1000 hours and 82.1% after 120° C./1000 hours. With a preceding cold deformation of 40%, yield strengths were achieved of 622 MPa at an A10 elongation of 4.6%, a conductivity of 24.8% IACS, and minBR/t perpendicular/parallel of 1.5/7.5. The stress relaxation resistance was 90.2% of the initial stress after 100° C./1000 hours and 79.8% after 120° C./1000 hours.

After the rolling to the final thickness and tempering at 250° C./3 hours, with a 24% preceding cold deformation, yield strengths were achieved of 586 MPa at an A10 elongation of 9.8% and a conductivity of 25.3% IACS. The minimum bending radius in relation to the strip thickness (minBR/t perpendicular/parallel) in the V-forging die was 0.4/2.8.

COMPARATIVE EXAMPLE 2

(CuZn23.5Sn1.0):—Coarse-Grained

The composition corresponds to that of comparative example 1, the manufacturing is the same as in comparative example 1 up to the cold rolling to 0.33 mm. However, the second annealing, in contrast to comparative example 1, is not performed at 320° C./3 hours, but rather at 520° C./3 hours.

After the annealing at 520° C./3 hours, the yield strength was 106 MPa at a grain size of 45 μm and a conductivity of 27.9% IACS.

After the rolling to the final thickness and tempering at 300° C./5 minutes, at a 24% preceding cold deformation, yield strengths were achieved of 378 MPa at an A10 elongation of 33.7% and a conductivity of 26.9% IACS. The minimum bending radius in relation to the strip thickness (minBR/t perpendicular/parallel) in the V-forging die was 2.4/1.6. The stress relaxation resistance is 94.7% of the initial stress after 100° C./1000 hours and 93.0% after 120° C./1000 hours.

With a preceding cold deformation of 40%, yield strengths were achieved of 503 MPa at an A10 elongation of 10.2%, a conductivity of 26.5% IACS, and minBR/t perpendicular/parallel of 3.5/4.0. The stress relaxation resistance was 96.1% of the initial stress after 100° C./1000 hours and 91.2% after 120° C./1000 hours.

After the rolling to the final thickness and tempering at 250° C./3 hours, with a 24% preceding cold deformation, yield strengths were achieved of 402 MPa at an A10 elongation of 29.5% and a conductivity of 27.3% IACS. The minimum bending radius in relation to the strip thickness (minBR/t perpendicular/parallel) in the V-forging die was 2.8/2.8. The stress relaxation resistance was 98.7% of the initial stress after 100° C./1000 hours and 93.5% after 120° C./1000 hours. With a preceding cold deformation of 40%, yield strengths were achieved of 517 MPa at an A10 elongation of 8.3%, a conductivity of 26.4% IACS, and minBR/t perpendicular/parallel of 4.5/6.0. The stress relaxation resistance was 96.8% of the initial stress after 100° C./1000 hours and 91.9% after 120° C./1000 hours.

The comparison of comparative example 1 with comparative example 2 shows, after the second annealing, a yield strength higher by 200 MPa of the fine-grained microstructure in comparison to the coarse-grained microstructure. The following cold deformation reduces this difference to still 160 MPa in the sample deformed by 24% and to 110 MPa in the sample deformed by 40%. In the final state after annealing at 300° C./5 minutes, a comparable yield strength of approximately 520 MPa can be achieved both of the coarse-grained manufacturing (503 MPa) with a 40% rolling reduction and also of the fine-grained manufacturing (541 MPa) with a 24% rolling reduction. Simultaneously, however, the A10 elongations in the fine-grained manufacturing are more favorable with 19.3% in comparison to 10.2% in the coarse-grained manufacturing. The minimum bending radii in relation to the strip thickness for the fine-grained manufacturing at 0.4/1.2 are similarly favorable in comparison to the coarse-grained manufacturing at 3.5/4. Only the stress relaxation resistance is slightly more favorable for the coarse-grained microstructure with 96.1% residual stress (fine-grained: 92.3% residual stress) after 100° C./1000 hours and with 91.2% residual stress (fine-grained: 82.1% residual stress) after 120° C./1000 hours.

EXAMPLE 3

(CuZn23.5Sn1.0Fe0.6):—Fine-Grained

The alloy components were melted in the graphite crucible and subsequently laboratory sample blocks were cast in steel ingot molds via the Tammann method. The composition of a laboratory block sample was Cu 74.95%-Zn 23.40%-Sn 1.06%-Fe 0.59% (see Table 1). After the milling to 22 mm thickness, the samples were hot rolled at 700-800° C. to 12 mm and subsequently milled to 10 mm. The microstructure displayed smaller particles, <1 μm, after the hot rolling. The <1 μm particles were identified as ferrous by means of EDX. After the cold rolling to 1.8 mm, the alloy was annealed at 500° C./3 hours. A yield strength of 304 MPa was achieved at a grain size of 5-15 μm and a conductivity of 24.2% IACS. After the subsequent cold rolling to 0.33 mm and annealing at 520° C./3 hours, the yield strength was 339 MPa at a grain size of 3-4 μm and a conductivity of 24.3% IACS.

After the rolling to the final thickness and tempering at 300° C./5 minutes, at a 24% preceding cold deformation, yield strengths were achieved of 623 MPa at an A10 elongation of 10.5% and a conductivity of 22.9% IACS. The minimum bending radius in relation to the strip thickness (minBR/t perpendicular/parallel) in the V-forging die was 2.4/3.6. The stress relaxation resistance was 90.7% of the initial stress after 100° C./1000 hours and 79.2% after 120° C./1000 hours.

With a preceding cold deformation of 40%, yield strengths were achieved of 686 MPa at an A10 elongation of 6.5%, a conductivity of 22.8% IACS, and minBR/t perpendicular/parallel of 4/10.

After the rolling to the final thickness and annealing at 250° C./3 hours, with a 24% preceding cold deformation, yield strengths were achieved of 632 MPa at an A10 elongation of 9.4% and a conductivity of 23.2% IACS. The minimum bending radius in relation to the strip thickness (minBR/t perpendicular/parallel) in the V-forging die was 3.2/4.8. The stress relaxation resistance was 90.8% of the initial stress after 100° C./1000 hours and 80.1% after 120° C./1000 hours. With a preceding cold deformation of 40%, yield strengths were achieved of 713 MPa at an A10 elongation of 2.8%, a conductivity of 23.0% IACS, and minBR/t perpendicular/parallel of 5/10.

In comparison to the fine-grained variant without Fe in comparative example 1, the ferrous fine-grained variant, after the final annealing at 300° C./5 minutes, displays a higher yield strength by 82 MPa (24% rolling reduction) or 64 MPa (40% rolling reduction), respectively.

With both alloy variants, a comparable yield strength of 620 MPa can be achieved, with different manufacturing, however. Thus, CuZn23.5Sn1.0Fe0.6 achieves a yield strength of 623 MPa after 24% rolling reduction and final annealing at 300° C./5 minutes and CuZn23.5Sn1.0 achieves a yield strength of 622 MPa after 40% rolling reduction and final annealing at 300° C./5 minutes. However, the A10 elongations in the ferrous variant are higher at 10.5% in comparison to 4.6% with CuZn23.5Sn1.0. The minimum bending radii in relation to the strip thickness are similarly favorable for the ferrous variant at 2.4/3.6 in comparison to the nonferrous variant at 1.5/7.5. The stress relaxation resistance of both variants is similar, in contrast.

At an image enlargement of 5000:1 and 10,000:1, the number of particles per 1 $\mu m^2$ image detail was counted, see figures 1 and 2. The microstructure of a surface grind was shown by means of an AsB detector on the scanning electron microscope. The diameter of the majority of the iron particles is less than 200 nm, particles greater than 200 nm and less than 1 μm exist in isolation. The particle density is on average 1.2/$\mu m^2$.

EXAMPLE 4

(CuZn23.5Sn1.0Fe0.6P0.2):—Fine-Grained

The alloy components were melted in the graphite crucible and subsequently laboratory sample blocks were cast in steel ingot molds via the Tammann method. The composition of a laboratory block sample is Cu 74.77%-Zn 23.45%-Sn 1.04%-Fe 0.56%-P 0.19%, see Table 1. After the milling to 22 mm thickness, the samples were hot rolled at 700-800° C. to 12 mm and subsequently milled to 10 mm. The microstructure displayed smaller particles, <1 μm. In addition, several coarser particles, >1 μm, are present in the matrix. The particles were identified as FeP-containing by means of EDX. After the cold rolling to 1.8 mm, the alloy was annealed at 500° C./3 hours. A yield strength of 293 MPa was achieved in this case at a grain size of 10 μm and a conductivity of 26.6% IACS. After the subsequent cold rolling to 0.33 mm and annealing at 370° C./3 hours, the yield strength was 393 MPa at a grain size of 3-4 μm and a conductivity of 26.7% IACS.

After the rolling to the final thickness and tempering at 300° C./3 hours, at a 24% preceding cold deformation, yield strengths were achieved of 633 MPa at an A10 elongation of 11.6% and a conductivity of 24.2% IACS. The minimum bending radius in relation to the strip thickness (minBR/t perpendicular/parallel) in the V-forging die was 2/4.8. The stress relaxation resistance was 91.2% of the initial stress after 100° C./1000 hours and 81.3% after 120° C./1000 hours. With a preceding cold deformation of 40%, yield strengths were achieved of 710 MPa at an A10 elongation of 3.1%, a conductivity of 23.7% IACS, and minBR/t perpendicular/parallel of 3.5/11. The stress relaxation resistance was 90.1% of the initial stress after 100° C./1000 hours and 79.6% after 120° C./1000 hours.

After the rolling to the final thickness and tempering at 250° C./3 hours, with a 24% preceding cold deformation, yield strengths were achieved of 641 MPa at an A10 elongation of 9.5% and a conductivity of 23.6% IACS. The minimum bending radius in relation to the strip thickness (minBR/t perpendicular/parallel) in the V-forging die was 2/6. The stress relaxation resistance was 93.5% of the initial stress after 100° C./1000 hours and 81.0% after 120° C./1000 hours. With a preceding cold deformation of 40%, yield strengths were achieved of 723 MPa at an A10 elongation of 1.4%, a conductivity of 23.8% IACS, and minBR/t perpendicular/parallel of 4.5/10.5. The stress relaxation resistance was 92.9% of the initial stress after 100° C./1000 hours and 78.4% after 120° C./1000 hours.

In comparison to the fine-grained variant in comparative example 1, the FeP-containing fine-grained variant, after the final annealing at 300° C./5 minutes, displays a higher yield strength by 92 MPa (24% rolling reduction) or 88 MPa (40% rolling reduction), respectively.

Both fine-grained alloy variants achieved a comparable yield strength of 620-630 MPa in each case after a 24% rolling reduction and final annealing at 300° C./5 minutes (CuZn23.5Sn1.0Fe0.6P0.2: Rp0.2=633 MPa) and after a 40% rolling reduction and final annealing at 300° C./5 minutes (CuZn23.5Sn1.0: Rp0.2=622 MPa). However, the A10 elongations in the FeP containing variant are higher at 11.6% in comparison to 4.6% with CuZn23.5Sn1.0. The minimum bending radii in relation to the strip thickness are similarly favorable for the FeP-containing variant at 2.0/4.8 in comparison to the nonferrous variant at 1.5/7.5. The stress relaxation resistance of both variants is similar.

EXAMPLE 5

(CuZn23.5Sn1.0Fe0.6P0.2):—Coarse-Grained

The composition corresponds to that of example 4, the manufacturing is the same as in example 4 up to the cold rolling to 0.33 mm. However, the second annealing, in contrast to example 4, is not performed at 370° C./3 hours, but rather at 520° C./3 hours. A yield strength was achieved of 212 MPa in this case at a grain size of 10-25 μm and a conductivity of 26.7% IACS.

After the rolling to the final thickness and tempering at 300° C./5 minutes, at a 24% preceding cold deformation, yield strengths were achieved of 534 MPa at an A10 elongation of 23.1% and a conductivity of 24.5% IACS. The minimum bending radius in relation to the strip thickness (minBR/t perpendicular/parallel) in the V-forging die was 2.4/3.2. The stress relaxation resistance was 95.8% of the initial stress after 100° C./1000 hours and 90.9% after 120° C./1000 hours. With a preceding cold deformation of 40%, yield strengths were achieved of 634 MPa at an A10 elongation of 7.8%, a conductivity of 24.1% IACS, and minBR/t perpendicular/parallel of 3.5/8.5. The stress relaxation resistance was 93.9% of the initial stress after 100° C./1000 hours and 85.2% after 120° C./1000 hours.

After the rolling to the final thickness and annealing at 250° C./3 hours, at a 24% preceding cold deformation, yield strengths were achieved of 544 MPa at an A10 elongation of 17.8% and a conductivity of 24.7% IACS. The minimum bending radius in relation to the strip thickness (minBR/t perpendicular/parallel) in the V-forging die was 3.2/4.0. The stress relaxation resistance was 95.1% of the initial stress after 100° C./1000 hours and 90.1% after 120° C./1000 hours. With a preceding cold deformation of 40%, yield strengths were achieved of 642 MPa at an A10 elongation of 4.3%, a conductivity of 24.0% IACS, and minBR/t perpendicular/parallel of 4.5/8.5. The stress relaxation resistance was 95.0% of the initial stress after 100° C./1000 hours and 86.4% after 120° C./1000 hours.

The comparison of example 4 with example 5 shows, after the second annealing, a yield strength higher by 180 MPa of the fine-grained microstructure in comparison to the coarse-grained microstructure. The following cold deformation reduces this difference to 60 MPa in the sample deformed by 24% and to 40 MPa in the sample deformed by 40%. After the final annealing at 300° C./5 minutes, the difference of the yield strength between coarse-grained and fine-grained is 100 MPa (degree of deformation 24%) and 75 MPa (degree of deformation 40%).

In the final state after the annealing at 300° C./5 minutes, a comparable yield strength of approximately 630 MPa can be achieved both of the coarse-grained manufacturing (634 MPa) with a 40% rolling reduction and also of the fine-grained manufacturing (633 MPa) with a 24% rolling reduction. Simultaneously, however, the A10 elongations in the fine-grained manufacturing are more favorable with 11.6% in comparison to 7.8% in the coarse-grained manufacturing. The minimum bending radii in relation to the strip thickness for the fine-grained manufacturing at 2.0/4.8 are similarly favorable in comparison to the coarse-grained manufacturing at 3.5/8.5. Only the stress relaxation resistance is slightly higher for the coarse-grained microstructure with 93.9% residual stress (fine-grained: 91.2% residual stress) after 100° C./1000 hours and with 85.2% residual stress (fine-grained: 81.3% residual stress) after 120° C./1000 hours.

EXAMPLE 6

(CuZn30Sn1.0Fe0.6):—Fine-Grained

The alloy components were melted in the graphite crucible and subsequently laboratory sample blocks were cast in steel ingot molds via the Tammann method. The composition of the laboratory block sample was Cu 68.26%-Zn 30.16%-Sn 1.03%-Fe 0.55%, see Table 1. After the milling to 22 mm thickness, the samples were hot rolled at 700-800° C. to 12 mm and subsequently milled to 10 mm. The microstructure displayed smaller particles, <1 μm, after the hot rolling. The <1 μm particles were identified as ferrous by means of EDX. After the cold rolling to 1.8 mm, the alloy was annealed at 500° C./3 hours. A yield strength of 339 MPa was achieved in this case at a grain size of 5 μm and a conductivity of 23.1% IACS.

In principle, in addition to the Tammann method mentioned in the examples, other suitable casting methods can also be used. Strip casting also comes into consideration in this context in particular.

After the subsequent cold rolling to 0.33 mm, a part was annealed at 520° C./3 hours. A yield strength of 340 MPa was achieved in this case at a grain size of 3-4 μm and a conductivity of 23% IACS.

After the rolling to the final thickness and tempering at 300° C./5 minutes, at a 12% preceding cold deformation, yield strengths were achieved of 486 MPa at an A10 elongation of 19.0% and a conductivity of 22.2% IACS. The minimum bending radius in relation to the strip thickness (minBR/t perpendicular/parallel) in the V-forging die was 0/0. The stress relaxation resistance was 88% of the initial stress after 100° C./1000 hours and 76.7% after 120° C./1000 hours.

With a preceding cold deformation of 18%, yield strengths were achieved of 550 MPa at an A10 elongation of 21.3%, a conductivity of 21.9% IACS, and minBR/t perpendicular/parallel of 0.9/0.4. The stress relaxation resistance was 88.3% of the initial stress after 100° C./1000 hours and 75.6% after 120° C./1000 hours.

After the rolling to the final thickness and annealing at 250° C./3 hours, with a 12% preceding cold deformation, yield strengths were achieved of 505 MPa at an A10 elongation of 18.5% and a conductivity of 22.6% IACS. The minimum bending radius in relation to the strip thickness (minBR/t perpendicular/parallel) in the V-forging die was 0/0. The stress relaxation resistance was 87.3% of the initial stress after 100° C./1000 hours and 76.2% after 120° C./1000 hours. With a preceding cold deformation of 18%, yield strengths were achieved of 564 MPa at an A10 elongation of 19.9%, a conductivity of 22.2% IACS, and minBR/t perpendicular/parallel of 0.9/0.6. The stress relaxation resistance was 88.4% of the initial stress after 100° C./1000 hours and 77.6% after 120° C./1000 hours.

After the cold rolling to 0.33 mm, a further part was annealed at 450° C./30 seconds. A yield strength of 460 MPa was achieved in this case at a grain size of 1-2 μm and a conductivity of 22.6% IACS.

After the rolling to the final thickness and tempering at 300° C./5 minutes, at a 24% preceding cold deformation, yield strengths were achieved of 649 MPa at an A10 elongation of 9.0% and a conductivity of 21.8% IACS. The minimum bending radius in relation to the strip thickness (minBR/t perpendicular/parallel) in the V-forging die was 1.6/6.4. The stress relaxation resistance was 77.9% of the initial stress after 100° C./1000 hours and 61.0% after 120° C./1000 hours.

With a preceding cold deformation of 40%, yield strengths were achieved of 704 MPa at an A10 elongation of 2.9%, a conductivity of 21.5% IACS, and minBR/t perpendicular/parallel of 2/6.4. The stress relaxation resistance was 77.5% of the initial stress after 100° C./1000 hours and 61.8% after 120° C./1000 hours.

After the rolling to the final thickness and annealing at 250° C./3 hours, with a 24% preceding cold deformation, yield strengths were achieved of 687 MPa at an A10 elongation of 3.9% and a conductivity of 21.9% IACS. The minimum bending radius in relation to the strip thickness (minBR/t perpendicular/parallel) in the V-forging die was 2/4.8. The stress relaxation resistance was 77.4% of the initial stress after 100° C./1000 hours and 61.5% after 120° C./1000 hours. With a preceding cold deformation of 40%, yield strengths were achieved of 765 MPa at an A10 elongation of 1.5%, a conductivity of 21.6% IACS, and minBR/t perpendicular/parallel of 4.0/9.2. The stress relaxation resistance was 76.8% of the initial stress after 100° C./1000 hours and 59.9% after 120° C./1000 hours.

The microstructure of a surface grind was shown by means of a AsB detector on the scanning electron microscope. At an image enlargement of 5000:1 and 10,000:1, the number of particles per 1 $\mu m^2$ image detail was counted. The diameter of at least 90% of the iron particles is less than 200 nm. Iron particles having a diameter of 200 nm to 1 μm exist at less than 10%. The particle density is on average 0.9 particles per $\mu m^2$.

Further samples were also manufactured and tempered in the operating scale. To evaluate the tin plating ability, a multiple wave soldering test was carried out according to DIN EN 60068-2-20. The samples were pickled. The solder bath consisted of Sn60Pb40 at 235° C. The test was performed at an immersion speed of 25 mm/second and a dwell time of 5 seconds, wherein pure rosin at 260 g/L was used as a flux. The samples were evaluated as good during the subsequent visual check.

By means of a Lücke-type goniometer, the main texture types were ascertained by x-ray diffractometry in all samples from Table 3 on the 18%, 24%, and 40% cold-deformed plate annealed at 300° C./5 minutes. For this purpose, the intensity distributions of the skeleton lines in Euler space and the orientation distribution functions were analyzed. The proportion of the copper orientation, S/R orientation, brass orientation, Goss orientation, 22RD cube orientation, and cube orientation as the respective main texture orientations is shown in Table 4. The ratio of the volumes of the brass orientation to the copper orientation is less than 1 in all cases. For comparison, the ratio of the volume of the brass orientation to the copper orientation in the comparative alloy CuZn30 has a value of 1.38 at a degree of rolling reduction of 47% during the final shaping. The designation S/R orientation refers to the respective identical orientations originating from the rolling texture or recrystallization texture in Euler space. The 22RD cube orientation designates a cube orientation rotated by ø=22° in Euler space. These designations have also become common for other specifications used in the literature in the meantime in practice for sample characterization.

COMPARATIVE EXAMPLE 7

(CuZn10Sn1.7Fe1.7P0.025)

127 mm×820 mm blocks of the composition Cu 86.29%-Zn 10.21%-Sn 1.70%-Fe 1.74%-P 0.025% were extruded and hot rolled to 14.7 mm at 890° C. After the cold rolling to 1.4 mm, annealing at 450° C./2 hours, cold rolling to 0.4 mm, annealing at 420° C./4 hours, rolling to 0.254 mm, and annealing at 280° C./4 hours, yield strengths of 633 MPa, an A10 elongation of 8.7% and a minimum bending radius in relation to the strip thickness (minBR/t perpendicular/parallel) in the V-forging die of 1.6/2.0 were achieved. Subsequently, the strips were hot-dip tin plated with a layer thickness of 2-3 μm. The tin plating result is flawed, pores and stripes occur. The linear irregularities on the tin plated surface originate from the elongated Fe lines, on which no Cu is present to form an intermetallic phase.

COMPARATIVE EXAMPLE 8

CuZn23.5Sn1.0Fe2.0

The alloy components were melted in the graphite crucible and subsequently laboratory sample blocks were cast in steel ingot molds via the Tammann method. The composition of the laboratory block sample was Cu 73.82%-Zn 23.19%-Sn 1.04%-Fe 1.95%, see Table 1. After the milling to 22 mm thickness, the samples were hot rolled at 700-800° C. to 12 mm. The microstructure displayed smaller particles, less than 1 μm, similarly to CuZn23.5Sn1.0Fe0.6. In addition, coarse particles approximately 5 μm in size were present in CuZn23.5Sn1.0Fe2.0. Both the particles smaller than 1 μm and the particles 5 μm in size were identified as ferrous by means of EDX.

After the cold rolling to 1.8 mm, the alloy was annealed at 500° C./3 hours. A yield strength of 362 MPa was achieved in this case at a grain size of 2-3 μm and a conductivity of 24.2% IACS. After the subsequent cold rolling to 0.33 mm and annealing at 520° C./3 hours, the yield strength was 386 MPa at a grain size of 2 μm and a conductivity of 24.0% IACS.

After the rolling to the final thickness and tempering at 300° C./5 minutes, at a 24% preceding cold deformation, yield strengths were achieved of 642 MPa at an A10 elongation of 8.4% and a conductivity of 23.1% IACS. The minimum bending radius in relation to the strip thickness (minBR/t perpendicular/parallel) in the V-forging die was 2/5.

With a preceding cold deformation of 40%, yield strengths were achieved of 712 MPa at an A10 elongation of 5.0%, a conductivity of 22.4% IACS, and minBR/t perpendicular/parallel of 2.5/9.

Elongated lines having a length of greater than 20 μm developed in the course of the further manufacturing from the particles of approximately 5 μm in size present after the hot rolling.

To evaluate the tin-plating ability, a multiple wave soldering test was carried out according to DIN EN 60068-2-20 on the samples tempered at 300° C./5 minutes. The samples were pickled and brushed. The solder bath consisted of Sn60Pb40 at 235° C. The test was performed at an immersion speed of 25 mm/second and a dwell time of 5 seconds, wherein pure rosin at 260 g/L was used as a flux. The samples were evaluated as bad during the subsequent visual check as a result of strong dewetting.

The elongated ferrous lines are the cause of the poor tin plating ability of the samples. No Cu is present thereon to form an intermetallic phase and undesired irregularities occur on the tin-plated strips.

TABLE 1

| composition of the copper alloys in wt.-% | | | | | | |
|---|---|---|---|---|---|---|
| Nominal composition | Example | Cu, % | Zn, % | Sn, % | Fe, % | P, % |
| CuZn23.5Sn1.0 | comparative example 1 | 75.47 | 23.47 | 1.06 | | |
| | comparative example 2 | | | | | |
| CuZn23.5Sn1.0Fe0.6 | example 3 | 74.95 | 23.40 | 1.06 | 0.59 | |
| CuZn23.5Sn1.0Fe0.6P0.2 | example 4 | 74.77 | 23.45 | 1.04 | 0.56 | 0.19 |
| | example 5 | | | | | |

TABLE 1-continued

| composition of the copper alloys in wt.-% | | | | | | |
|---|---|---|---|---|---|---|
| Nominal composition | Example | Cu, % | Zn, % | Sn, % | Fe, % | P, % |
| CuZn30Sn1Fe0.6 | example 6 | 68.26 | 30.16 | 1.03 | 0.55 | |
| CuZn10Sn1.7Fe1.7P0.025 | comparative example 7 | 86.29 | 10.21 | 1.70 | 1.74 | 0.025 |
| CuZn23.5Sn1.0Fe2.0 | comparative example 8 | 73.82 | 23.19 | 1.04 | 1.95 | |

TABLE 2

| properties after the last cold rolling to final thickness and annealing 250° C./3 hours | | | | | | | | |
|---|---|---|---|---|---|---|---|---|
| | | Hot rolling, 3 cold rolling steps, and final annealing 250° C./3 hours | | | | | | |
| Example | ID | Degree of rolling reduction final shaping, % | % IACS | Rp0.2, MPa | Rm, MPa | Grain size, μm | minBR/t Q | minBR/t P |
| Comparative example 1 | CuZn23.5Sn1.0 | 24 | 25.3 | 586 | 641 | 2-3 | 0.4 | 2.8 |
| Comparative example 2 | CuZn23.5Sn1.0 | 24 | 27.3 | 402 | 468 | 50 | 2.8 | 2.8 |
| | | 40 | 26.4 | 517 | 566 | 45 | 4.5 | 6 |
| Example 3 | CuZn23.5Sn1.0Fe0.6 | 24 | 23.2 | 632 | 674 | Stretched | 3.2 | 4.8 |
| | | 40 | 23 | 713 | 765 | Stretched | 5 | 10 |
| Example 4 | CuZn23.5Sn1.0Fe0.6P0.2 | 24 | 23.6 | 641 | 703 | 1-2 | 2 | 6 |
| | | 40 | 23.8 | 723 | 783 | 1-2 | 4.5 | 10.5 |
| Example 5 | CuZn23.5Sn1.0Fe0.6P0.2 | 24 | 24.7 | 544 | 592 | 10-15 | 3.2 | 4 |
| | | 40 | 24 | 642 | 689 | 5-10 | 4.5 | 8.5 |
| Example 6 | CuZn30.0Sn1.0Fe0.6 | 18 | 22.2 | 564 | 609 | 2 | 0.9 | 0.6 |
| | | 24 | 21.9 | 687 | 748 | 1-2 | 2 | 4.8 |
| | | 40 | 21.6 | 765 | 829 | 2 | 4 | 9.2 |

TABLE 3

| properties after the last cold rolling to final thickness and annealing 300° C./5 minutes | | | | | | | | |
|---|---|---|---|---|---|---|---|---|
| | | Hot rolling, 3 cold rolling steps, and final annealing 300° C./5 minutes | | | | | | |
| Example | ID | Degree of rolling reduction final shaping, % | % IACS | Rp0.2, MPa | Rm, MPa | Grain size, μm | minBR/t Q | minBR/t P |
| Comparative example 1 | CuZn23.5Sn1.0 | 24 | 25.1 | 541 | 604 | 2-3 | 0.4 | 1.2 |
| | | 40 | 24.8 | 622 | 694 | 2-3 | 1.5 | 7.5 |
| Comparative example 2 | CuZn23.5Sn1.0 | 24 | 26.9 | 378 | 454 | 40-50 | 2.4 | 1.6 |
| | | 40 | 26.5 | 503 | 557 | 40 | 3.5 | 4 |
| Example 3 | CuZn23.5Sn1.0Fe0.6 | 24 | 22.9 | 623 | 667 | 2-3 | 2.4 | 3.6 |
| | | 40 | 22.8 | 686 | 742 | 3 | 4 | 10 |
| Example 4 | CuZn23.5Sn1.0Fe0.6P0.2 | 24 | 24.2 | 633 | 699 | 1-2 | 2 | 4.8 |
| | | 40 | 23.7 | 710 | 756 | 1-2 | 3.5 | 11 |
| Example 5 | CuZn23.5Sn1.0Fe0.6P0.2 | 24 | 24.5 | 534 | 580 | 10-15 | 2.4 | 3.2 |
| | | 40 | 24.1 | 634 | 675 | 5-10 | 3.5 | 8.5 |
| Example 6 | CuZn30.0Sn1.0Fe0.6 | 18 | 21.9 | 550 | 606 | 2-3 | 0.9 | 0.4 |
| | | 24 | 21.8 | 649 | 720 | 1-2 | 1.6 | 6.4 |
| | | 40 | 21.5 | 704 | 782 | 2 | 2 | 6.4 |

TABLE 4 main texture orientations in volume percent of the alloys from Table 3

| Example | ID | Hot rolling, 3 cold rolling steps, and final annealing 300° C./5 minutes | | | | | | | |
|---|---|---|---|---|---|---|---|---|---|
| | | Degree of rolling reduction, % | Copper orien-tation vol.-% | S/R orien-tation vol.-% | Brass orien-tation vol.-% | Goss orien-tation vol.-% | 22RD cube orien-tation vol.-% | Cube orien-tation vol.-% | Brass/ Copper orien-tation |
| Comparative | CuZn23.5Sn1.0 | 24 | 14.7 | 15.4 | 8.8 | 4.4 | 5.3 | 2.0 | 0.60 |
| example 1 | | 40 | 14.5 | 16.0 | 10.0 | 5.0 | 4.7 | 1.4 | 0.69 |
| Comparative | CuZn23.5Sn1.0 | 24 | 14.9 | 15.0 | 7.9 | 4.1 | 5.2 | 1.8 | 0.53 |
| example 2 | | 40 | 12.1 | 18.2 | 9.7 | 7.5 | 4.7 | 0.9 | 0.80 |
| Example 3 | CuZn23.5Sn1.0Fe0.6 | 24 | 17.8 | 19.8 | 9.4 | 4.5 | 4.0 | 1.2 | 0.53 |
| Example 4 | CuZn23.5Sn1.0Fe0.6P0.2 | 24 | 15.9 | 15.4 | 11.3 | 5.7 | 3.5 | 1.3 | 0.71 |
| Example 5 | CuZn23.5Sn1.0Fe0.6P0.2 | 24 | 17.7 | 17.3 | 8.8 | 7.5 | 4.4 | 1.0 | 0.50 |
| Example 6 | CuZn30.0Sn1.0Fe0.6 | 18 | 15.3 | 17.6 | 8.1 | 2.9 | 4.2 | 2.1 | 0.53 |
| | | 24 | 12.1 | 16.8 | 10.2 | 3.7 | 4.4 | 2.3 | 0.84 |

The invention claimed is:

1. A copper alloy, which was subjected to a thermomechanical treatment, consisting of, in wt. %:

28.5 to 31.5% Zn,
0.3 to 3.0% Sn,
0.55 to 0.7% Fe,
optionally 0.001 to 0.4% P,
optionally 0.01 to 0.1% Al,
optionally 0.01 to 0.3% Ag, 0.01 to 0.3% Mg, 0.01 to 0.3% Zr, 0.01 to 0.3% In, 0.01 to 0.3% Co, 0.01 to 0.3% Cr, 0.01 to 0.3% Ti, and 0.01 to 0.3% Mn,
optionally 0.05 to 0.5% Ni,
the remainder being copper and unavoidable impurities, wherein the microstructure of the alloy is characterized in that
the proportions of the main texture orientations are
at least 10 vol.-% copper orientation,
at least 10 vol.-% SIR orientation,
at least 5 vol.-% brass orientation,
at least 2 vol.-% Goss orientation,
at least 2 vol.-% 22RD cube orientation,
at least 0.5 vol.-% cube orientation, and
finely distributed ferrous particles are contained in the alloy matrix.

2. The copper alloy as claimed in claim 1, characterized by a content of
0.7 to 1.5% Sn.

3. The copper alloy as claimed in claim 1, characterized in that the ratio of the proportions of the main texture orientations of brass orientation and copper orientation is less than 1.

4. The copper alloy as claimed in claim 3, characterized in that the ratio of the proportions of the main texture orientations of brass orientation and copper orientation is between 0.4 and 0.90.

5. The copper alloy as claimed in claim 1, characterized in that finely distributed ferrous particles having a diameter less than 1 μm are present at a density of at least 0.5 particles per $\mu m^2$ in the alloy matrix.

6. The copper alloy as claimed in claim 1, characterized in that the mean grain size of the alloy matrix is less than 10 μm.

* * * * *

UNITED STATES PATENT AND TRADEMARK OFFICE

CERTIFICATE OF CORRECTION

PATENT NO. : 9,493,858 B2
APPLICATION NO. : 14/235884
DATED : November 15, 2016
INVENTOR(S) : Hans-Achim Kuhn et al.

It is certified that error appears in the above-identified patent and that said Letters Patent is hereby corrected as shown below:

In the Claims

At Column 15, Line 38:
Change "at least 10 vol.-% SIR orientation,"
to ---at least 10 vol.-% S/R orientation,---

Signed and Sealed this
Twenty-fifth Day of April, 2017

Michelle K. Lee

Michelle K. Lee
*Director of the United States Patent and Trademark Office*